US009707461B1

(12) United States Patent
McKnight

(10) Patent No.: US 9,707,461 B1
(45) Date of Patent: Jul. 18, 2017

(54) TOSS GAME TARGET AND METHOD OF PLAY

(71) Applicant: Kevin J. McKnight, Springfield, PA (US)

(72) Inventor: Kevin J. McKnight, Springfield, PA (US)

( * ) Notice: Subject to any disclaimer, the term of this patent is extended or adjusted under 35 U.S.C. 154(b) by 0 days.

(21) Appl. No.: 15/132,209

(22) Filed: Apr. 18, 2016

(51) Int. Cl.
*A63B 63/00* (2006.01)
*A63B 67/06* (2006.01)
*A63B 63/08* (2006.01)

(52) U.S. Cl.
CPC ..... *A63B 67/06* (2013.01); *A63B 63/08* (2013.01); *A63B 63/00* (2013.01)

(58) Field of Classification Search
CPC ..... A63B 67/06; A63B 63/08; A63B 63/00; A63F 9/02; A63F 9/0204
USPC ..... 273/398–402, 348, 354
See application file for complete search history.

(56) References Cited

U.S. PATENT DOCUMENTS 1,442,054 A * 1/1923 Dixon ..... A63F 9/0204 273/397
2,977,429 A 3/1961 Zimmerman
3,790,174 A * 2/1974 Skillern ..... F41J 13/02 273/394
4,863,175 A * 9/1989 Ricks, Jr. ..... A63B 63/08 273/342
5,052,693 A 10/1991 Hicks
5,123,656 A 6/1992 Green
5,553,725 A * 9/1996 Clemons ..... A47G 19/2227 215/6
D375,529 S * 11/1996 Kohler ..... D21/303
5,632,490 A * 5/1997 Brown ..... A63F 7/048 273/138.3
6,669,200 B1 * 12/2003 Knetsch ..... A63B 67/06 273/400
6,843,478 B1 * 1/2005 Hoepelman ..... A63B 63/00 273/342
6,899,336 B2 * 5/2005 Michelet ..... A63B 63/007 273/342
7,134,662 B2 11/2006 Menendez
D691,660 S * 10/2013 Shea ..... D21/303
9,199,149 B2 * 12/2015 Max ..... A63B 63/08
9,248,357 B2 * 2/2016 Francis ..... A63B 63/00
2007/0284824 A1 * 12/2007 Arden ..... A63B 67/083 273/317
2010/0320692 A1 * 12/2010 Tookey ..... A63B 67/06 273/398
2015/0246280 A1 * 9/2015 Shea ..... A63F 9/02 273/350

* cited by examiner

*Primary Examiner* — Mark Graham
(74) *Attorney, Agent, or Firm* — LaMorte & Associates, P.C.

(57) ABSTRACT

A toss game assembly that includes a projectile and a target for receiving the projectile. The target has a series of concentric cylinders. A target receptacle is suspended inside the cylindrical wall of the outer cylinder at a first distance below its top edge. During play, a person can toss the projectile into the top of any of the concentric cylinders. Alternatively, a user can direct the projectile to rebound into the target receptacle on the cylindrical wall of the outer cylinder. Different points are assigned to different target areas, wherein the smaller the target opening the more points are awarded for placing the tossed projectile into that target area.

16 Claims, 3 Drawing Sheets

TOSS GAME TARGET AND METHOD OF PLAY

BACKGROUND OF THE INVENTION

1. Field of the Invention

In general, the present invention relates to projectile toss games where a projectile, such as a ball or beanbag, is tossed toward a target. More particularly, the present invention relates to the structure of the toss game target, especially toss game targets that embody concentric target areas.

2. Prior Art Description

Games in which a person tosses a projectile into a target have been in existence throughout recorded history. In this long period of time, many variations of the game have developed. Games exist where projectiles have been tossed into various objects, such as baskets, buckets, and rings. The present invention is directed toward a subsection of projectile toss games where a projectile is tossed into a target that consists of concentric circles.

The popular game of Skee-ball® has been in existence since 1909. In Skee-ball®, a player rolls a ball toward a ramp. The ramp launches the ball toward an inclined set of concentric circles. Each of the circles has a different point value, with the highest point value circle typically being located in the center. In variations of the traditional Skee-ball® game, a special target is placed in a target area that otherwise has no value or a low value. The specialized target has the highest point value in the game and may even be an "instant win" target. The purpose of this specialized target is to entice players to toss the projectile toward the low value area. The specialized target also gives players who are outmatched buy opponents the chance to stay competitive or even win the game.

Although Skee-ball® remains a popular game, it is not a portable game. Skee-ball® games require long heavy boards upon which the balls are rolled. In order to make the game of Skee-ball® portable, variations of the game have been developed that eliminate the need for the long game bowling ramp. In portable versions of the game, balls or other projectiles are tossed in flight toward the target, rather than rolled. The target boards are also inclined differently so that they can better receive a ball falling from above, rather than a ball being launch from below. Such portable games are exemplified by U.S. Pat. No. 2,977,429 to Zimmerman.

When a ball is thrown toward a target, it has much more downward momentum than does a ball that is rolled up a ramp toward a target. As such, it has been discovered that a ball thrown at a target of concentric circles tends to bounce off of the target rather than be captured by one of the concentric circles. The solution to this problem has been to make the walls of the concentric circles very high in relation to the diameter of the concentric circles. In this manner, the circles become cylinders that can capture a tossed projectile within their centers. Such prior art is exemplified by U.S. Pat. No. 5,052,693 to Hicks, U.S. Pat. No. 5,123,656 to Green and U.S. Pat. No. 7,134,662 to Menendez.

Although a target with high-wall concentric cylinders enables a tossed ball to be easily captured, the high-wall system inhibits the use of an offset high value target in an otherwise low value field. Thus, one of the more entertaining aspects of the traditional game of Skee-ball® cannot be reintroduced.

A need therefore exists for toss game target system that has concentric cylinders that are capable of capturing a projectile in flight, yet also provides an offset specialized target that does not interfere with the ability of the other concentric cylinders to receive projectiles. This need is met by the present invention as described and claimed below.

SUMMARY OF THE INVENTION

The present invention is a toss game assembly that includes a projectile and a target for receiving the projectile. The target has a series of concentric cylinders. This includes an inner cylinder having a first diameter and a first height. It also includes an outer cylinder that is concentrically positioned about the inner cylinder. The outer cylinder has a cylinder wall of a second height that extends to a top edge.

A specialty target is attached to the interior of the cylindrical wall of the outer cylinder at a first distance below the top edge. During play, a person can toss the projectile into the top of any of the concentric cylinders. Alternatively, a user can direct toward the top edge of one of the concentric cylinders in an attempt to have the projectile rebound and land in the specialty target. Different points are assigned to different target areas, wherein the smaller the target opening the more points are awarded for placing the tossed projectile into that target area.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention toss game target can be embodied in different ways, the embodiment illustrated shows the toss game target with three concentric cylinders and a special target. This embodiment is selected in order to set forth the best mode contemplated for the invention. The illustrated embodiment, however, is merely exemplary and should not be considered a limitation when interpreting the scope of the appended claims.

Figure 1:
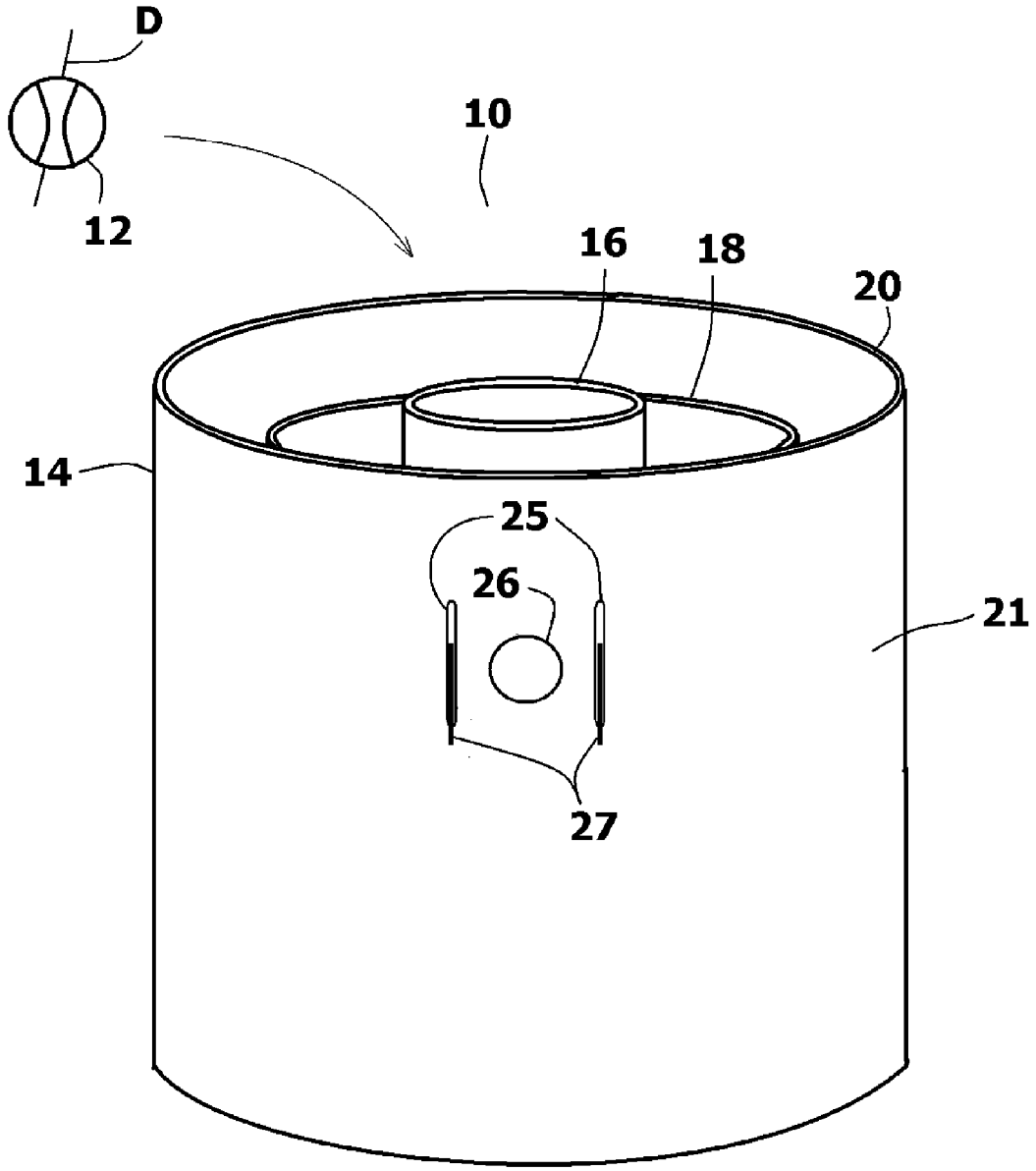
FIG. 1 is a perspective view of an exemplary embodiment of a toss game assembly in accordance with the present invention.
Figure 2:
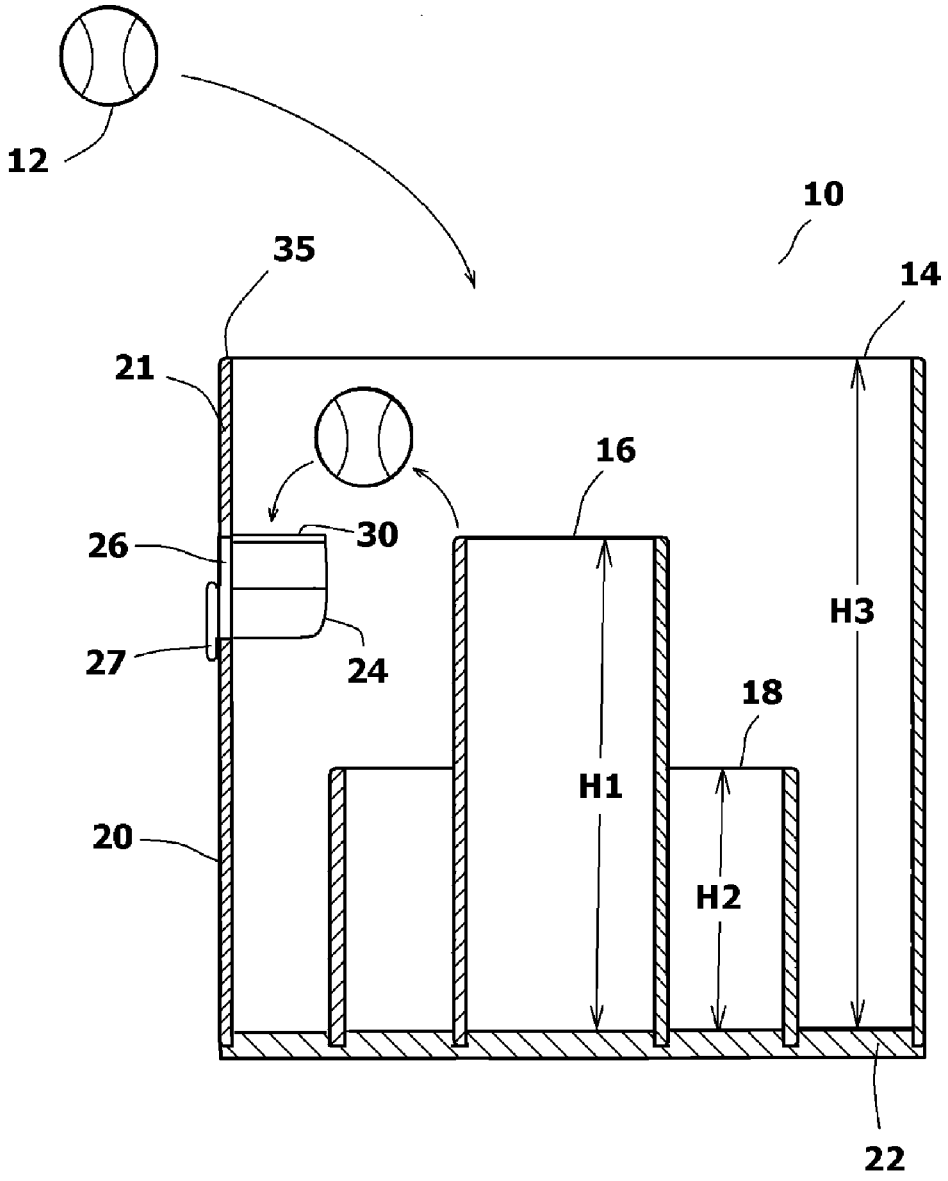
FIG. 2 is a cross-sectional view of the exemplary embodiment of FIG. 1 viewed along section line 2-2.
Figure 3:
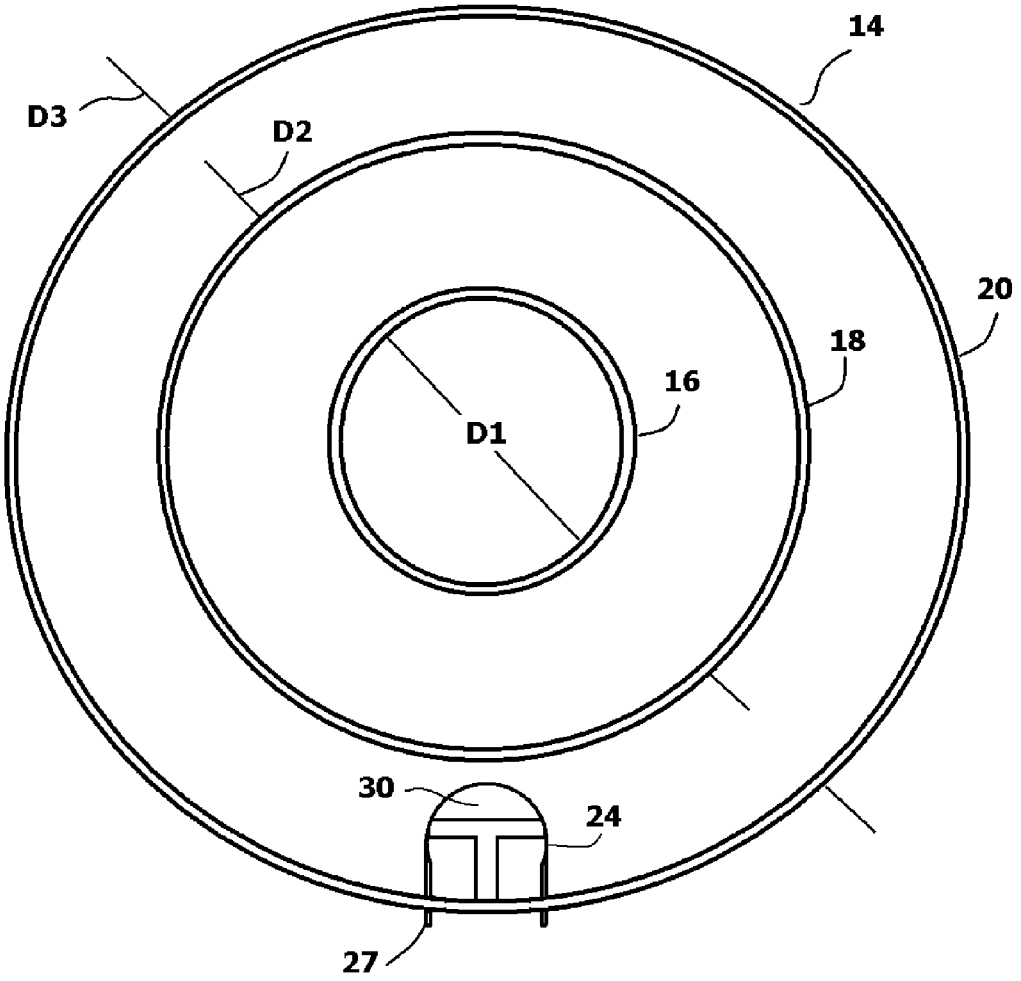
FIG. 3 is a top view of the exemplary embodiment of FIG. 1.

Referring to FIG. 1 and FIG. 2 in conjunction with FIG. 3, a toss game assembly 10 is shown. The toss game assembly 10 contains a projectile 12, in the form of a ball or bean bag, and a target 14 in the form of concentric cylinders. The projectile 12 has a maximum diameter of D, which is preferably between two inches and five inches.

The target 14 is configured from a series of concentric cylinders 16, 18, 20. Each of the cylinders is concentric, yet has a different diameter and height. Each of the concentric cylinders 16, 18, 20 has an open top that enables the concentric cylinders 16, 18, 20 to capture a tossed projectile 12.

The inner cylinder 16 has a first diameter D1 and a first height H1. The first diameter D1 of the inner cylinder 16 is preferably between 1.5 and 2 times the diameter D of the projectile 12. As such, the projectile 12 can enter the interior of the inner cylinder 16 if precisely aimed. The first height H1 of the inner cylinder 16 is preferably between two times and three times the length of the first diameter D1. As such, the inner cylinder 16 is higher than it is wide.

The middle cylinder 18 has a second diameter D2. The second diameter D2 of the middle cylinder 18 is approximately twice as wide as the first diameter D1 of the inner cylinder 16. The middle cylinder 18 is also shorter than the inner cylinder 16, having a height H2 that is between ½ and ¼ of the height H1 of the inner cylinder 16. As such, the middle cylinder 18 is wider than it is tall.

The outer cylinder 20 has a third diameter D3. The third diameter D3 is approximately three times as wide as the first diameter D1 of the inner cylinder 16. The outer cylinder 20 is the tallest cylinder, having a height H3 that is equal to, or within a few inches of its diameter D3.

The three cylinders 16, 18, 20 are concentrically mounted. As such, the three cylinders 16, 18, 20 maintain their concentric configuration while being struck by projectiles. In the shown embodiment, the three cylinders 16, 18, 20 are mounted to a common base 22. However, it will be understood that the three cylinders 16, 18, 20 can be mounted to internal arms that space the cylinders 16, 18, 20 while maintaining an open bottom to the overall target 14.

A specialty target 26 is attached to the interior of the cylindrical wall 21 of the outer cylinder 14. The specialty target 26 is a small target with an open top 30. The open top 30 is preferably round, however, other shapes can also be used. The maximum size of the open top 30 of the specialty target 26 is preferably between 25% and 75% larger than the diameter D of the projectile 12. As such, the specialty target 24 in the presents the smallest opening in the target 14 into which the thrown projectile 12 can pass.

The specialty target 26 attaches to the interior of the cylindrical wall 21. This can be accomplished in many ways. In the illustrated embodiment, the specialty target 28 engages slots 25 in the cylindrical wall 21 with hook mounts 27. Due to the location of the specialty target 26, the open top 30 of the specialty target 26 typically cannot be seen by a person tossing the projectile 12. The open top 30 of the specialized target 24 is positioned on the outer cylinder 20 at a point between half and three-quarters the height H3 of the outer cylinder 20. The target hole 24 is, therefore, positioned a first distance below the top edge 35 of the cylindrical wall 21. As such, the target hole 24 will not be directly struck by a projectile 12 tossed by a skilled player. Rather, to pass a projectile 12 into the specialized target 24, a player must bounce or ricochet the projectile off some inner surface of the target 14. It will therefore be understood that the best technique to place the projectile 12 in the specialized target 24 is to bounce the projectile 12 off the top edge of the center cylinder 16. However, since the specialized target 24 is located on the outer cylinder 20, if the tossed projectile 12 just misses the specialized target 24, the projectile 12 will fall to the bottom of the target 14 in the lowest score area.

If the projectile 12 does manage to deflect into the specialized target 24, this fact would be unobservable if the cylindrical wall 21 of the outer cylinder were both solid and opaque. The inner cylinder 16 and the middle cylinder 18 have solid and opaque cylindrical walls. The outer cylinder 20 has a solid and opaque cylindrical wall 21 with the exception of an observation hole 26.

The observation hole 26 is positioned on the outer cylinder 20 just in front of the specialized target 24. The observation hole enables a person to view the interior of the specialized target 24 through the cylindrical wall 21 of the outer cylinder 20. In this manner, there is no problem in determining if a tossed projectile 12 enters the specialized target.

The toss game can be played with one or two targets 14. Players are handed projectiles 12 to toss. A player tosses the projectile 12 at the target 14 from a distance of between 10 feet and 20 feet from the target 14. If the tossed projectile 12 enters the inner cylinder 16, there is a first score. If the tossed projectile 12 enters the middle cylinder 18, there is a lesser second score. If the tossed projectile enters the outer cylinder 20, the player gets the smallest score.

A player can forego tossing the projectiles 12 toward the open tops of the cylinders 16, 18, 20 and can instead aim the projectile 12 toward top edges of the cylinders 16, 18, 20 in the hope of creating a rebounding projectile. If the projectile 12 enters the specialized target 24, the highest point score is awarded. Alternatively, the player may obtain an instant win. However, if the projectile 12 misses the specialized target 24, it may fall to the ground outside of the target 14 or may land in the area of the fewest points.

It will be understood that the embodiment of the present invention that is illustrated and described is merely exemplary and that a person skilled in the art can make many variations to that embodiment. For instance, the number of cylinders in the target can be varied. The cylinders can have polygonal cross-sections instead of circular. The projectiles can have many different shapes and the specialized target can have many different shapes. All such embodiments are intended to be included within the scope of the present invention as defined by the claims.

What is claimed is:

1. A target for a projectile toss game, comprising:

an inner cylinder having a first diameter and a first height;

an outer cylinder concentrically positioned about said inner cylindrical, said outer cylinder having a cylinder wall with a second height that extends to a top edge;

a specialized target area supported by said cylindrical wall of said outer cylinder at a first distance below said top edge; and a hole formed through said cylindrical wall of said outer cylinder for viewing said specialized target area through said cylindrical wall.

2. The target according to claim 1, wherein said second height of said outer cylinder is greater than said first height of said inner cylinder.

3. The target according to claim 2, wherein said outer cylinder has a diameter at least three times as large as said inner cylinder.

4. The target according to claim 3, further including a third cylinder concentrically positioned between said inner cylinder and said outer cylinder.

5. The target according to claim 4, wherein said third cylinder has a third height that is less than said first height of said inner cylinder.

6. The target according to claim 1, wherein said specialized target area has an open top with a diameter no greater than said first diameter of said inner cylinder.

7. The target according to claim 1, wherein said target area is a receptacle disposed within said outer cylinder for receiving and retaining any projectile that passes therein.

8. The target according to claim 1, wherein said inner cylinder and said outer cylinder are mounted to a common base.

9. A projectile toss game, comprising:

a ball projectile having a first diameter;

a series of concentric cylinders that includes an outer cylinder with an outer cylindrical wall, wherein each of said series of concentric cylinders has an exposed open end capable of receiving said ball projectile therein;

a target receptacle disposed on said cylindrical wall of said outer cylinder, wherein said target receptacle has an entrance of a second diameter that is no greater than twice that of said first diameter of said ball projectile; and a hole formed through said cylindrical wall of said outer cylinder for viewing said target receptacle through said cylindrical wall.

10. The game according to claim 9, wherein said series of concentric cylinders includes an inner cylinder, wherein said inner cylinder has a third diameter, wherein said second diameter of said target receptacle is smaller than said third diameter of said inner cylinder.

11. The game according to claim 9, wherein said cylindrical wall of said outer cylinder has a top edge and said target receptacle extends from said cylindrical wall at a first distance below said top edge.

12. The game according to claim 9, wherein said series of concentric cylinders are mounted to a common base.

13. A target for a projectile toss game, comprising:

an inner cylinder having a first diameter and a first height;

a middle cylinder having a second diameter and a second height, wherein said middle cylinder is concentrically positioned about said inner cylinder, and wherein said second height of said middle cylinder is less than said first height of said inner cylinder;

an outer cylinder concentrically positioned about said middle cylinder, said outer cylinder having a cylindrical wall with a third height that extends to a top edge and a third diameter, wherein said third diameter is at least three times as large as said first diameter of said inner cylinder; and a target receptacle suspended from said cylindrical wall of said outer cylinder below said top edge, wherein said target receptacle has a entrance with a diameter smaller than said first diameter of said inner cylinder.

14. The target according to claim 13, wherein said first height of said inner cylinder is greater than said second height of said middle cylinder.

15. The target according to claim 13, wherein said third height of said outer cylinder is greater than said first height of said inner cylinder.

16. The target according to claim 13, further including a hole formed through said cylindrical wall for viewing said target receptacle.

* * * * *